United States Patent [19]

Tallarita

[11] Patent Number: 4,925,370

[45] Date of Patent: May 15, 1990

[54] ELECTRIC MOTOR DRIVEN PUMP WITH AN AUTOMATIC TRANSMISSION

[76] Inventor: Domenic A. Tallarita, 1302 Fremont St., Anaheim, Calif. 92804

[21] Appl. No.: 282,392

[22] Filed: Dec. 9, 1988

[51] Int. Cl.[5] ..... F04B 49/00

[52] U.S. Cl. ..... 417/15; 417/223

[58] Field of Search ..... 417/15, 47, 223

[56] References Cited

U.S. PATENT DOCUMENTS

| | | | |
|---|---|---|---|
| 2,317,135 | 4/1943 | Crittenden et al. | 417/15 |
| 2,361,086 | 10/1944 | Carlson | 417/15 |
| 4,004,412 | 1/1977 | Burnell | 417/15 |
| 4,020,634 | 5/1977 | Bradley | 417/15 |
| 4,118,151 | 10/1978 | Murakami et al. | 417/223 |
| 4,143,996 | 3/1979 | Sullivan | 417/15 |
| 4,208,171 | 6/1980 | Jonsson | 417/15 |
| 4,295,792 | 10/1981 | Tachibana et al. | 417/15 |
| 4,347,041 | 8/1982 | Cooper | 417/15 |
| 4,381,174 | 4/1983 | Obler | 417/15 |
| 4,390,321 | 6/1983 | Langlois et al. | 417/15 |

*Primary Examiner*—Leonard E. Smith
*Assistant Examiner*—D. Scheuermann
*Attorney, Agent, or Firm*—Loyal M. Hanson; Gordon L. Peterson

[57] ABSTRACT

A pumping system includes a pump for pumping a liquid, a motor for driving the pump, and components for coupling the pump to the motor so that the speed at which the pump is driven varies automatically according to the load the liquid imposes. One embodiment employs an automotive fluid transmission with a torque converter for this purpose, along with input and output manifolds that enable connection to differently sized lines. These components may be mounted on a portable support structure, such as a cart, to form a fully automatic, portable pumping system arranged so that a user can manually move the system to a desired location, connect to variously sized lines, and pump any of various liquids having different or varying viscosities.

10 Claims, 1 Drawing Sheet

ELECTRIC MOTOR DRIVEN PUMP WITH AN AUTOMATIC TRANSMISSION

BACKGROUND OF THE INVENTION

1. Technical Field

This invention relates generally to pumps, and more particularly to a pumping system designed to better accommodate varying loads.

2. Background Information

One problem encountered with some pumping systems, such as a conventional gear pump driven by a constant speed electric motor, occurs when pumping liquids having different or varying viscosities, such as epoxy, lacquer, paint thinner, syrup, and the like. Not only do the viscosities of such liquids differ from each other, but the viscosity of any one may vary significantly with various changing conditions such as temperature. In addition, it may be desirable to pump the liquid through differently sized lines and this causes load variations as well. As a consequence, the pumping system must be designed to accommodate the varying load that can result because a system failure may have catastrophic consequences if it occurs when pumping a liquid such as epoxy that can quickly solidify in the pump and conduits.

To guard against that happening, some existing systems utilize a motor of sufficient size to handle the greatest load anticipated (i.e., that accompanying the greatest viscosity and smallest conduit or line expected). However, processing speed is then restricted to that which is safe under such worst case conditions so that in addition to such a technique being costly in terms of hardware, it is inefficient in terms of processing speed. Consequently, it is desirable to have a pumping system that alleviates these concerns.

A related problem occurs when the flow of liquid out of the pumping system is turned on and off, such as may occur in the normal course of such activates as packaging. Turning the flow of liquid off, for example, can cause an abrupt increase in the load and pressure. This only compounds the varying-load problem caused by different and varying viscosities.

Some existing systems avoid this problem by either simultaneously turning the motor on and off or by switching in a bypass arrangement that provides a path from the pumping system outlet back to the inlet. However, turning the motor on and off can be inconvenient and decrease processing speed, Furthermore, it can involve high starting currents each time the electric motor is turned back on. The use of a bypass arrangement also results in significant current fluctuations, a high pressure head tending to build up during bypass, and a fluid surge occurring when the system outlet is opened again. Thus, it is desirable to have a system that alleviates these concerns also.

SUMMARY OF THE INVENTION

This invention solves the problems outlined above with a pumping system having an automatic transmission between the pump and the motor that can automatically downshift as the load increases. Thus, it enables automatic adjustment to the load, pressure, hose size, and viscosity. It relieves worst case motor size requirements. It maintains the best processing speed automatically. It simplifies start-stop operations. It avoids current and pressure surges, and it allows the motor to continue running at full speed after the pump has slowed significantly or even stopped.

Generally, a system constructed according to a major aspect of the invention includes a pump for pumping a liquid, a motor for driving the pump, and components for coupling the pump to the motor so that the speed at which the pump is driven varies automatically according to the load the liquid imposes. These components may include an automatic transmission operatively connected between the motor and the pump, such as a slightly modified, automotive-type fluid transmission, and the automatic transmission may include a torque converter so that the motor can continue running at substantially full speed regardless of how slow the pump is operating.

According to another aspect of the invention, there is provided a portable pumping system that includes a pump, motor, and automatic transmission mounted on a portable support structure, such as a cart. These are accompanied by input and output manifolds that can be connected to differently sized lines and a control box with which a user can control operation of the motor and the automatic transmission. This arrangement enables a user to move the pumping system to a desired location, connect to variously sized lines, and pump any of various liquids having different or varying viscosities. It does not discriminate against hose size and multiple hose connections, and it eliminates the need for specific pump sizes.

In line with the above, a method of accommodating varying loads when pumping a liquid with a motor-driven pump includes the step of interposing an automatic transmission between the pump and a motor driving the pump in order to couple the pump to the motor so that the speed at which the pump is driven varies automatically according to the load. Although it is known to use a variable speed drive between a pump and a motor, this invention utilizes an automatic transmission that can downshift and upshift automatically in response to increases and decreases in the load. In so doing, it solves the problems discussed above while maintaining maximum flow under varying load conditions for a given horsepower motor, and the torque converter provides circuit protection and anti-surge operation as well as allowing the pump to slow to a complete stop.

The above mentioned and other objects and features of this invention and the manner of attaining them will become apparent, and the invention itself will be best understood, by reference to the following description taken in conjunction with the accompanying illustrative drawings.

DESCRIPTION OF THE PREFERRED EMBODIMENTS

Figure 1:
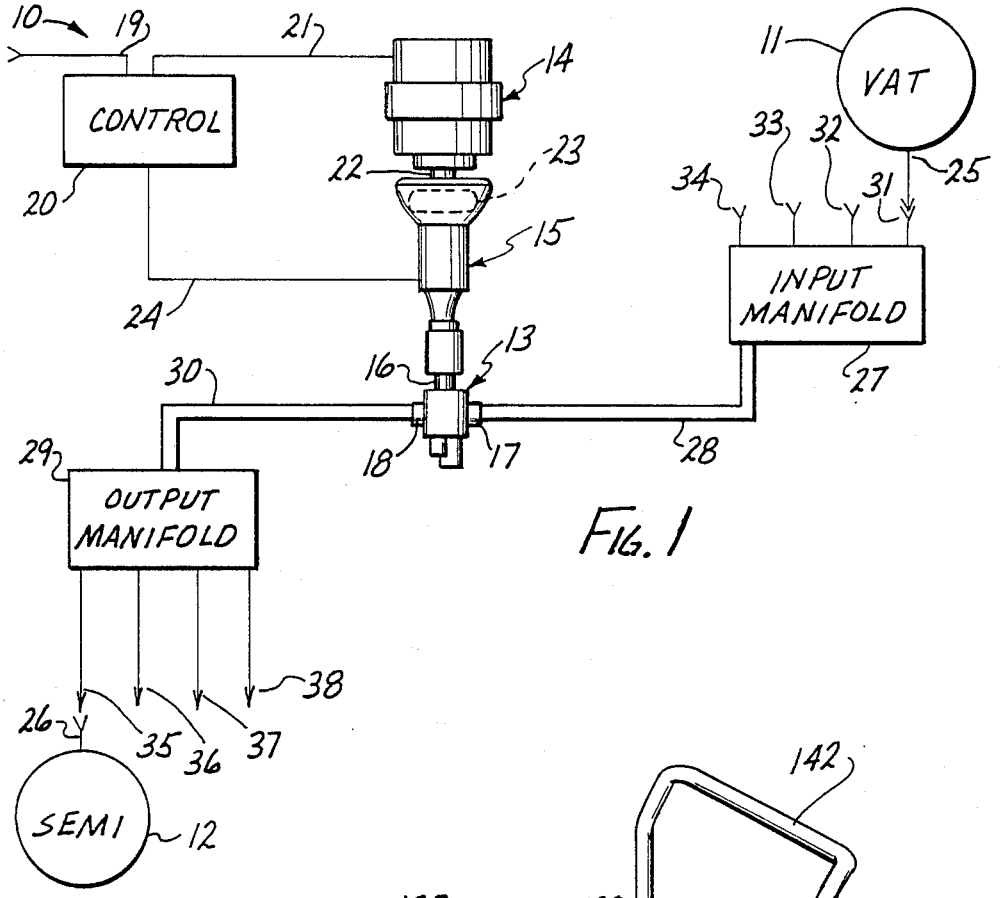
FIG. 1 of the drawings is a diagrammatic representation of a system constructed according to the invention.

Referring now to FIG. 1, there is shown a diagrammatic representation of a pumping system 10 constructed according to the invention. The system 10 is being utilized to pump a liquid, such as syrup, from a holding vat 11 to a semitrailer tank 12. Of course, it can be used to pump other liquids from any of various sources to any of various destinations, but it does so in a manner subsequently described that better accommodates varying loads imposed by the liquid.

Generally, the system 10 includes a pump 13 for pumping a liquid, a motor 14 for driving the pump 13, and a transmission 15 for coupling the pump 13 to the motor 14. The coupling is done according to a major aspect of the invention so that the speed at which the pump 13 is driven varies automatically according to the load the liquid imposes. This enables the system 10 to better accommodate varying loads and pressures.

The pump 13 may take the form of any of various known pumps, such as a three-inch, positive displacement, gear pump that operates conventionally by rotation of a shaft 16 to pump liquid communicated to a three-inch inlet 17 of the pump 13 out of a three-inch outlet 18 of the pump 13. The motor 14 may take the form of any of various known sources of rotary power, such as a 7 ½ horsepower, 1725 rpm, electric motor that operates on 110, 220, or 440 volts, for example, or a gasoline engine or any other means of driving the transmission. The motor 14 is powered by electric current coupled from a separate source (not shown) through a line 19, control box 20, and line 21, this being done in a suitable known way so that a user can control operation of the motor 14 (turn it on and off) from the control box 20.

The transmission 15 may take the form of any of various known automatic transmissions that can downshift or upshift automatically as the load or pressure increases or decreases (i.e., the ratio of output speed to input speed automatically decreases as the load increases and vice versa as the load decreases). In other words, the input of the transmission 15 is coupled by a shaft 22 to the motor 14 and the output of the transmission 15 is coupled by the shaft 16 to the pump. As the load presented to the transmission 15 by the shaft 16 increases beyond a predetermined value, the transmission 15 automatically shifts to a lower ratio so that the shaft 16 rotates more slowly for the same speed of the motor 14. Similarly, the transmission 15 can shift to a higher ratio when the load decreases.

In that regard, the transmission 15 is a commercially available automotive-type transmission, such as the transmission available from General Motors having the product name TURBO HYDRO 250. It has three forward speed ranges that may be designated HIGH, SECOND, and FIRST. For an input speed of 1725 rpm, HIGH results in an output speed of about 800–1725 rpm, SECOND results in an output speed of about 350–800 rpm, and FIRST results in an output speed of about 0–350 rpm.

The transmission 15 also includes a NEUTRAL position and a REVERSE speed range which results in the output rotating in a direction opposite to that of the above three speed ranges (at 0–350 rpm for an input speed of 1725 rpm) so that the flow of liquid can be reversed if desired. In addition, the transmission 15 includes a torque converter 23 that operates conventionally so that the motor 14 can continue to operate at substantially full speed regardless of how slow the pump 13 and shaft 16 rotate. In other words, the torque converter 23 serves as means for enabling the motor to continue running at substantially full speed regardless of how slow the pump is operating, and it protects against surges when the flow of liquid is turned on and off. Of course, various other types of automatic transmission may be used as long as they can automatically decrease the ratio of the output speed to the input speed when the load increases.

The transmission 15 is operatively connected between the pump 13 and the motor 14. It is connected to the shaft 16 of the pump 13 by known suitable means, such as a chain coupler, and to the motor 14 by suitable known means, such as a pulley system with a flywheel adapter arrangement. This couples the pump 13 to the motor 14 with the transmission 15 where many prior art pumping systems use a gear train.

A quarter-inch shift cable or control cable 24 extends from the transmission 15 to the control box 20. It operates conventionally to enable a user to select a desired range of the transmission. It is suitably connected according to known techniques to the control box 20 so that a user can control operation of the transmission 15 (select a desired range) from the control box 20. In other words, the user operates the control box 20 manually in a known way, such as by moving a switch or lever arm to a selected position. That is coupled by the control cable 24 to the transmission 15 in a known way to select a desired one of a plurality of continuous ranges of the transmission 15 according to the user's operation of the control box 20, and then the transmission 15 operates conventionally within the selected range to automatically vary the speed at which the pump is driven according to the load the liquid imposes. That is to say, the transmission operates at a reduced pump speed under heavier load conditions and vice versa, much the way an automatic transmission in an automobile operates under varying load conditions or drive requirements to vary the drive ratio between engine and wheels (as the automobile goes up and down hills, for example).

In addition to the foregoing, the system 10 includes input means for connecting the pump 13 to an input line in fluid communication with a source of liquid, such as a three-inch line 25 in fluid communication with the vat 11, and output means for connecting the pump 13 to an output line in fluid communication with a destination, such as a three-inch line 26 in fluid communication with the semitrailer tank 12 (FIG. 1). In the system 10, these functions are accomplished with an input manifold 27 connected by a conduit or line 28 in fluid communication with the inlet 17 of the pump 13, and an output manifold 29 connected by a conduit or line 30 with the outlet 18 of the pump 13.

The input manifold 27 has four differently sized inlets 31–34, each one being suitably sized for connection to a different size conduit or line. In other words, the inlet 31 is sized to receive a 3-inch line, the inlet 32 is sized to receive a 2-inch line, the inlet 33 is sized to receive a 1 ½ inch line, and the inlet 34 is sized to receive a 1-inch line. The output manifold is similarly configured, the outlets 35–38 receiving respective ones of 3-inch, 2-inch, 1 ½ inch, and 1-inch lines. Thus, the system 10 can accommodate different size lines both from the standpoint of having a suitably sized inlet and from the standpoint of being able to accommodate the different load resulting or the simultaneous use of one line for packaging and another line for transfer. Of course, a different number and size of manifold inlets and outlets can be provided.

Figure 2:
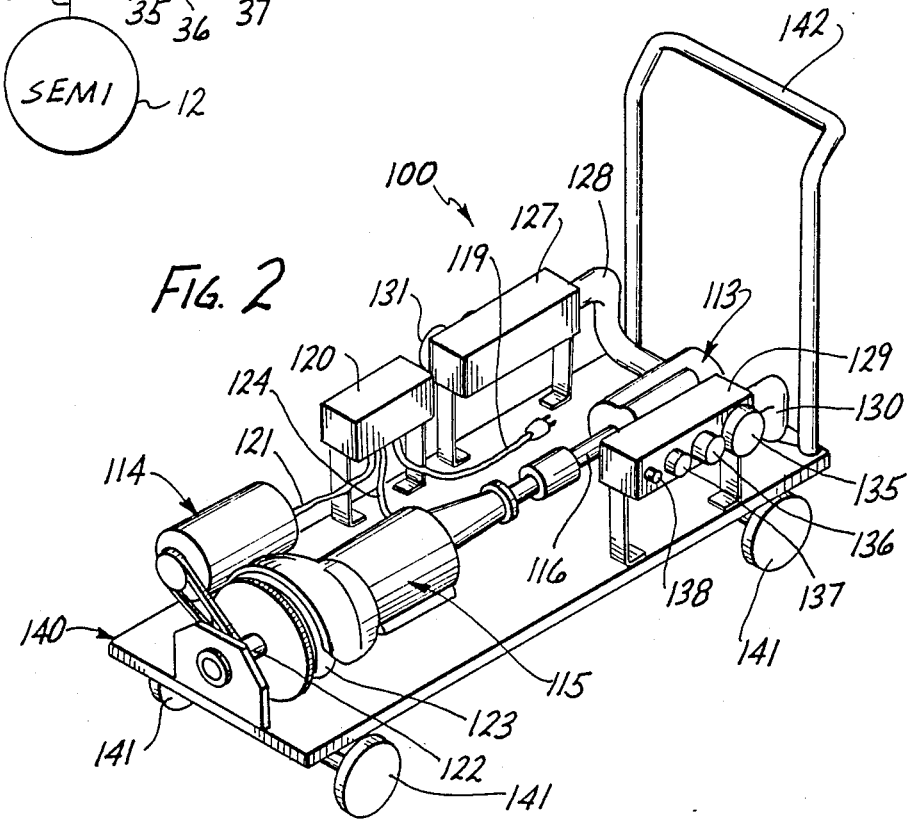
FIG. 2 is a perspective view of a portable pumping system.

Considering now FIG. 2, there is shown a portable pumping system or system 100 constructed according to another aspect of the invention. It is similar in many respects to the system 10 so that many of its components are not described in further detail. For convenience, many of the reference numerals designating parts in the system 100 are increased by one hundred over those designating similar parts of the system 10.

Similar to the system 10, the system 100 includes a pump 113 with which to pump a liquid, an input manifold 127 having a plurality of differently sized inlets (only inlet 131 being visible in FIG. 2) connected in fluid communication with the pump 113, and an output manifold 129 having a plurality of differently sized outlets 135–138 connected in fluid communication with the pump 113. It also includes an electric motor 114 and an automatic transmission 115 connected between the pump 113 and the motor 114 for coupling the pump 113 to the motor 114 so that the speed at which the pump 113 is driven varies automatically according to the load the liquid imposes. A control box arrangement 120 is also provided that serves as means for controlling operation of the motor 114 and the automatic transmission 115.

But unlike the system 10, the system 100 is configured for portable use. Thus, it includes a portable support structure 140 on which the other components are mounted by suitable known means. Although any of various portable support structures may be used, the support structure 140 takes the form of a cart with wheels 141 and a handle 142. It is arranged in this manner so that the system 100 can be transported manually (wheeled) to a selected pumping location.

Operationally, a user moves the support structure 140 to the selected pumping location. Next, the user connects an input line to an appropriately sized one of the inlets, such as the inlet 131 (FIG. 2), and an output line an appropriately sized one of the outlets 135–138. The inlets and outlets can be provided with caps (not shown) that seal the unused inlets and outlets, and the cap is simply unscrewed from the ones to be used.

Next, the user operates the motor 114 and the transmission 115 with the control box arrangement 120. This causes the pump 113 to pump the liquid. If the load increases, the transmission 115 automatically decreases the speed of the pump 113 so that the motor 114 can continue to operate at a substantially fixed speed, and vice versa if the load decreases. This occurs even if the pump 113 stops. If it is desired to reverse the flow of liquid, the REVERSE range of the transmission 115 is used.

Thus, this invention provides a method of accommodating varying loads and pressures when pumping a liquid with a motor-driven pump. This is done by interposing an automatic transmission between the pump and a motor driving the pump in order to couple the pump to the motor so that the speed at which the pump is driven varies automatically according to the load. Doing this enables fully automatic adjustment to the load. It relieves worst case motor size requirements. It maintains processing speed. It simplifies start-stop operations. It avoids current surges, and it allows the motor to continue running at full speed after the pump has slowed significantly or even stopped. In addition, the torque converter absorbs surges causes by start-stop operation.

Although an exemplary embodiment of the invention has been shown and described, many changes, modifications, and substitutions may be made by one having ordinary skill in the art without necessarily departing from the spirit and scope of the invention. For example, it is within the broader inventive concepts disclosed to use an automatic transmission for coupling a drive motor to other types of loads where obstructions or other conditions may cause the load to vary, such as a grain conveyor or luggage conveyor, for example, and the illustrations of the pumps in FIGS. 1 and 2 are intended to cover such other loads.

What is claimed is:

1. A portable pumping system, comprising:

a portable support structure;

a pump mounted on the portable support structure for pumping a liquid;

a motor mounted on the portable support structure for driving the pump;

input means mounted on the portable support structure for connecting the pump to an input line;

output means mounted on the portable support structure for connecting the pump to an output line;

means defining an automatic transmission having a plurality of continuous ranges of operation that is operatively connected between the motor and the pump for coupling the pump to the motor so that the speed at which the pump is driven varies automatically over a selected one of the plurality of continuous ranges of operation of the automatic transmission according to the load the liquid imposes; and control means operatively connected to the automatic transmission for enabling an operator to select a desired one of the plurality of continuous ranges of operation of the automatic transmission;

wherein:

the pump includes an inlet and an outlet;

the input means includes an input manifold having a plurality of differently sized inputs connected in fluid communication with the inlet of the pump; and the output means includes an output manifold having a plurality of differently sized outlets connected in fluid communication with the outlet of the pump.

2. A system as recited in claim 1, wherein the automatic transmission includes a reverse range of operation.

3. A system as recited in claim 1, wherein the automatic transmission includes:

an automotive-type fluid transmission.

4. A system as recited in claim 2, wherein the automatic transmission includes:

means for enabling the motor to continue running at substantially full speed regardless of how slow the pump is operating.

5. A system as recited in claim 4, wherein the means for enabling the motor to continue running at substantially full speed regardless of how slow the pump is operating includes:

a torque converter.

6. A system as recited in claim 1, wherein:

the input means includes means for connecting the pump to an input line having any one of a plurality of predetermined sizes; and the output means includes means for connecting the pump to an output line having any one of a plurality of predetermined sizes.

7. A pumping system, comprising:

a pump for pumping a liquid;

a motor for driving the pump;

means for coupling the pump to the motor so that the speed at which the pump is driven varies automatically according to the load the liquid imposes;

input means for connecting the pump to an input line; and output means for connecting the pump to an output line;

wherein:

the pump includes an inlet and an outlet;

the input means includes an input manifold having a plurality of differently sized inputs connected in fluid communication with the inlet of the pump; and the output means includes an output manifold having a plurality of differently sized outlets connected in fluid communication with the outlet of the pump.

8. A system as recited in claim 7, further comprising:

a portable support structure on which the other components of the system are mounted.

9. A system as recited in claim 8, wherein the portable support structure includes:

a cart.

10. A portable pumping system, comprising:

a support structure, which support structure is arranged so that it can be transported manually to a selected pumping location;

a pump mounted on the support structure, the pump having an inlet through which to receive a liquid and an outlet through which to pump the liquid;

an input manifold mounted on the support structure, the input manifold having a plurality of differently sized inlets connected in fluid communication with the inlet of the pump;

an output manifold mounted on the support structure, the output manifold having a plurality of differently sized outlets connected in fluid communication with the outlet of the pump;

an electric motor mounted on the portable support structure for driving the pump;

an automatic transmission connected between the pump and the motor for coupling the pump to the motor so that the speed at which the pump is driven varies automatically according to the load the liquid imposes; and control means mounted on the support structure and operationally interconnected with the motor and the automatic transmission for controlling operation of the motor and the automatic transmission.

* * * * *